United States Patent [19]

Thomas

[11] 4,233,999

[45] Nov. 18, 1980

[54] AUTOMATIC CURLING IRON

[76] Inventor: Louis N. Thomas, 990 NE. 156 Terrace, North Miami Beach, Fla. 33162

[21] Appl. No.: 939,468

[22] Filed: Sep. 5, 1978

[51] Int. Cl.[3] ..... A45D 2/12

[52] U.S. Cl. ..... 132/34 R

[58] Field of Search ..... 132/34 R, 37 R, 9

[56] References Cited

U.S. PATENT DOCUMENTS

| | | | |
|---|---|---|---|
| 447,492 | 3/1891 | Lovell | 308/202 |
| 530,787 | 12/1894 | Moore | 132/34 R |
| 1,589,117 | 6/1926 | Cotter | 132/34 R |
| 1,999,898 | 4/1935 | Fitzgerald | 132/37 R |
| 2,247,240 | 6/1941 | Klein | 132/34 R |
| 2,448,263 | 8/1948 | Hannon | 132/34 R |
| 2,524,058 | 10/1950 | Kamara | 132/34 R |
| 3,101,086 | 8/1963 | Di Vito | 132/DIG. 3 |
| 3,421,522 | 1/1969 | Magguilli | 132/11 R |

*Primary Examiner*—G. E. McNeill

*Attorney, Agent, or Firm*—Ernest H. Schmidt

[57] ABSTRACT

An electrical hair curling iron comprising an elongated, tubular heating member and a clamp bar pivotally arranged with respect to the heating member for receiving and clamping hair tresses to be curled against the heating member includes motor driven mechanism for automatically turning the clamp bar about the heating member in one direction or the other, selectively, as controlled by actuating means on the handle. A non-heated, tooth-like projection at the outer end of the heating member serves to facilitate the selection of strands of hair to be applied between the heating member and the clamp bar for curling, the clamp bar being provided with short comb teeth for uniformly distributing the hair strands along the length of the heating member during a curling operation.

10 Claims, 12 Drawing Figures

AUTOMATIC CURLING IRON

This invention relates to hair curling irons, and is directed particularly to an automatic curling iron of the type including a tubular heating member and clamp bar for clamping hair tresses to be curled against the tubular heating member, and further including motor driven means for automatically rotating the clamp bar about the heating member in one direction or the other, selectively, for automatically winding the hair about the heating member in one direction or the other.

Heretofore, hair curling irons basically comprised an elongated heating member, usually round, and a relatively pivoted clamp member operative to open to permit the insertion in place of hair strands to be curled, after which the hair curler was manually turned as a unit to wind and unwind the hair about the heating member during curling operations. It will readily be appreciated that considerable skill is required to perform the necessary manipulations for curling the hair with such prior manually operated hair curling irons. It is, accordingly, the principal object of this invention to provide a novel and improved curling iron wherein the hair pressing bar, in addition to being pivotally connected to permit opening for insertion of hair strands to be curled, is provided with motor driven means for automatically rotating the closed pressing bar about the length of the heating member in one direction or the other, selectively, thereby greatly simplifying hair curling operations.

Another object of the invention is to provide an automatic hair curling iron of the character described including a non-heated, tooth-like member fixed to and extending outwardly of the outer end of the heating member, which serves to separate the selected strands of hair to be clamped against the heating member for curling.

Another object of the invention is to provide an automatic hair curling iron wherein the elongated heating member is of tubular shape, within which an electrical heating element is slidingly received and frictionally retained, thereby providing for easy replacement or substitution with heating elements of different wattage or heating capacity.

Yet another object of the invention is to provide an automatic curling iron of the character described wherein the automatic turning of the hair pressing bar is positively controlled by conveniently located "in" (curling about the heating member) and "out" (uncurling the previously curled hair strands) at the forward end of the handle and readily actuated by the thumb while grasping the handle.

Yet another object of the invention is to provide an automatic hair curling iron of the character described including clutch mechanism serving to prevent free movement of the pressing bar about the heating member except when being motor driven thereabout by actuation of one or the other of the "in" and "out" control push buttons.

Still another object of the invention is to provide an automatic hair curling iron of the character described including means for adjusting the clamping pressure of the clamping bar with respect to the heating member, and wherein the clamping bar is toothed for distributing the strand of hair to be operated upon along the length of the heating member.

Other objects, features and advantages of the invention will be apparent from the following description when read with reference to the accompanying drawings. In the drawings, wherein like reference numerals denote corresponding parts throughout the several views.

Figure 12:
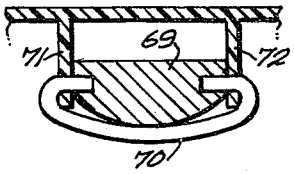
Figure 11:
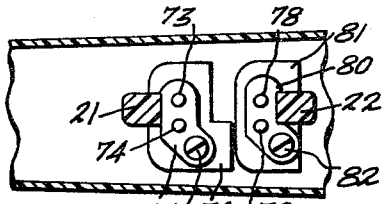
Figure 10:
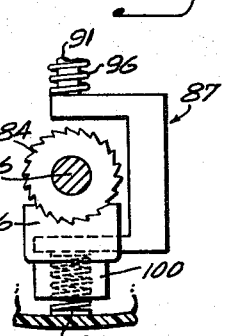
Figure 8:
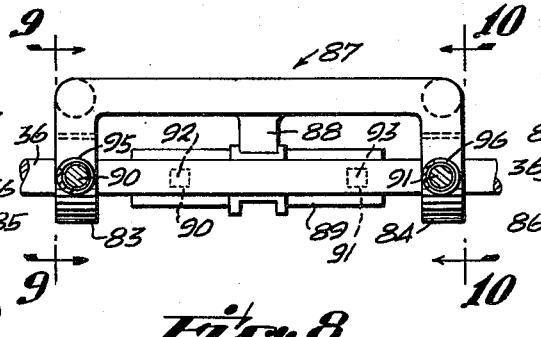
Figure 9:
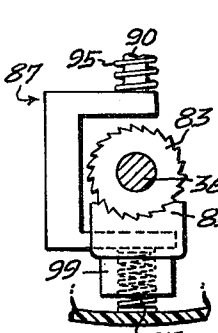
Figures 3A, 3B, 4, 5, 6, 7:
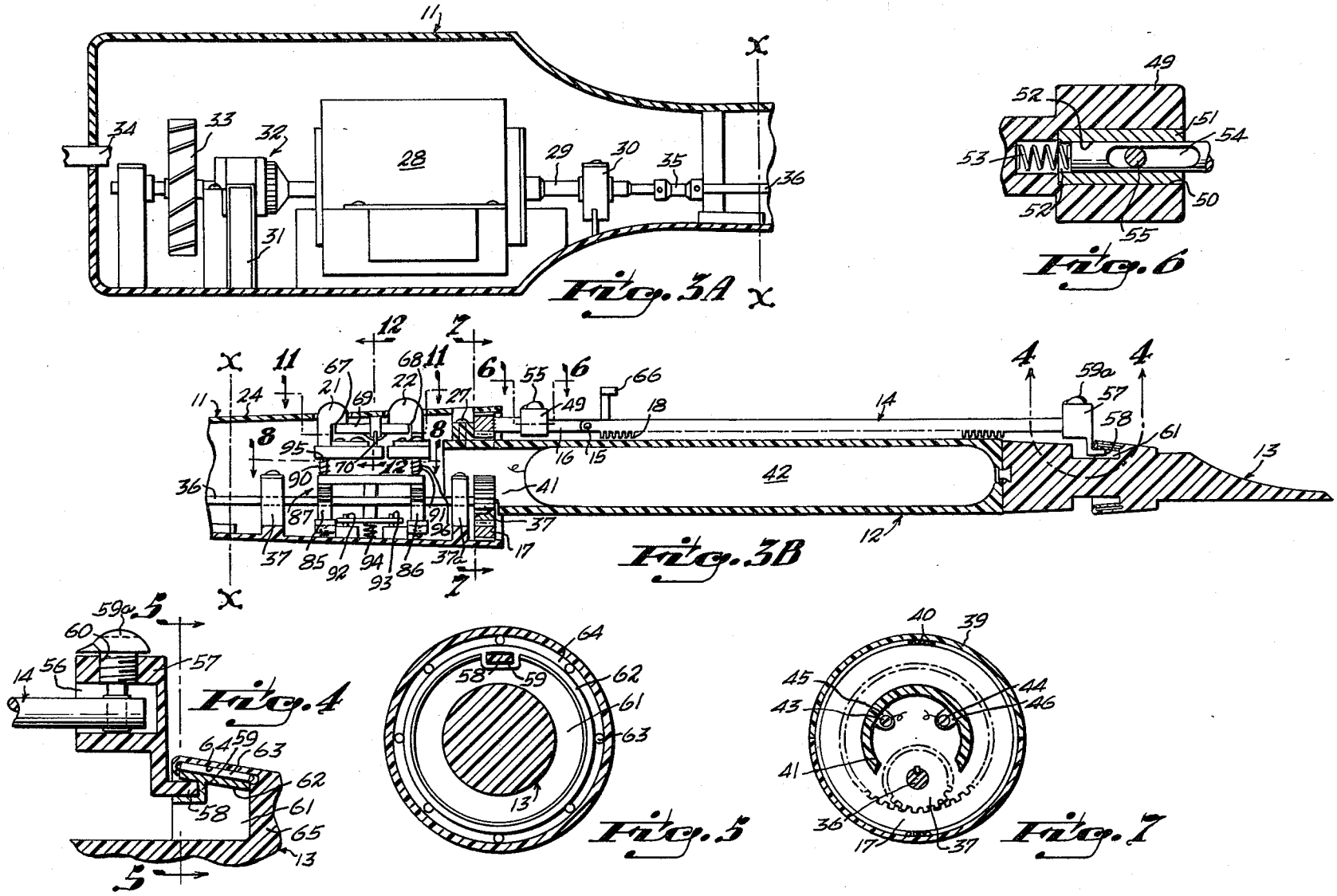

FIGS. 3A and 3B, taken together, constitute a longitudinal vertical cross-sectional view thereof;

FIG. 4 is an enlargement of the zone indicated at 4—4 in FIG. 3B, illustrating mechanical details of the pressing bar lock mechanism;

FIG. 5 is a vertical cross section taken along the line 5—5 of FIG. 4 in the direction of the arrows;

FIG. 6 is a partial horizontal, cross-sectional view taken along the line 6—6 of FIG. 3B and further illustrates details of the pressing bar lock mechansim;

FIG. 7 is a transverse, vertical cross-sectional view taken along the line 7—7 of FIG. 3B in the direction of the arrows and illustrates mechanical details of the planetary pressing bar rotating mechanism;

FIG. 8 is a partial horizontal, longitudinal cross-sectional view taken along the line 8—8 of FIG. 3B in the direction of the arrows and illustrates details of the rotary drive clutch mechanism;

FIG. 9 is a vertical cross-sectional view taken along the line 9—9 of FIG. 8, in the direction of the arrows;

FIG. 10 is a vertical cross-sectional view taken along the line 10—10 of FIG. 8, in the direction of the arrows;

FIG. 11 is a partial horizontal, longitudinal cross-sectional view taken along the line 11—11 of FIG. 3B in the direction of the arrows and illustrates details of the motor drive circuit switch; and FIG. 12 is a partial transverse vertical cross-sectional view taken along the line 12—12 of FIG. 3B in the direction of the arrows and illustrates details of the safety switch rocker bar contact.

Figure 1:
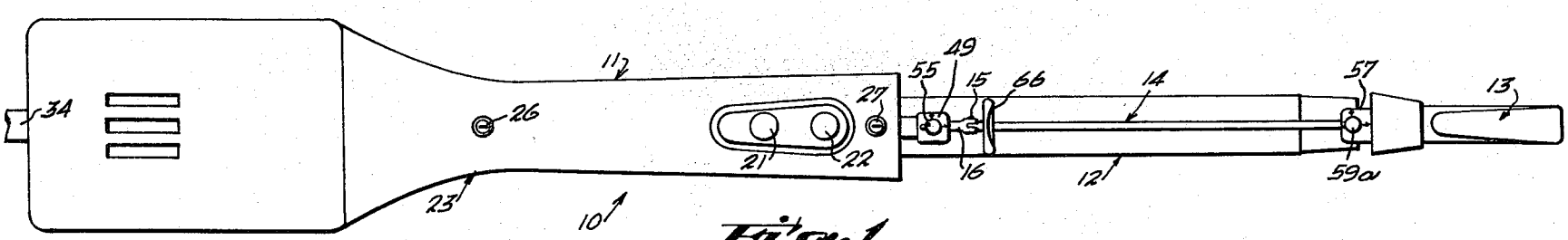
FIG. 1 is a top view of an automatic curling iron embodying the invention.
Figure 2:
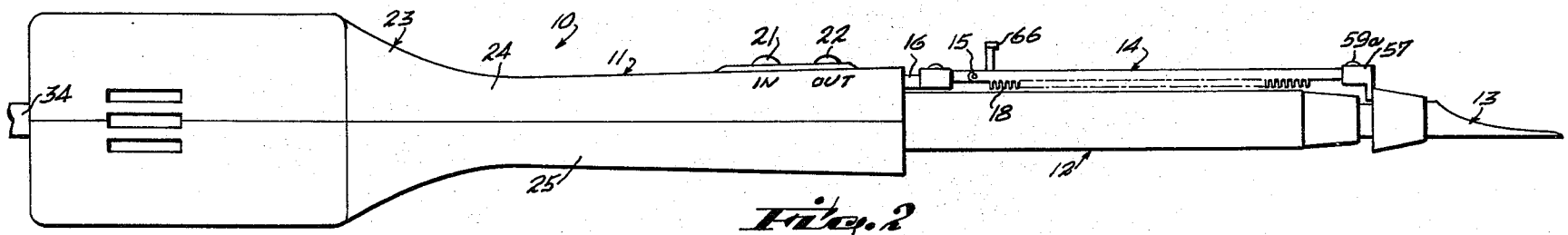
FIG. 2 is a side elevational view thereof.

Referring first to FIGS. 1 and 2 of the drawings, it will be seen that the automatic curling iron embodying my invention comprises a handle 11 projecting outwardly one end of which is a relatively fixed, tubular heating body 12 terminating in an elongated hair-separating tooth 13 fixed with respect to the outer end of the said heating body. An elongated pressing bar 14 is pivotally linked at one end, as by pivot pin 15, to a push bar 16 carried by revolvable carrier gear 17, and is fitted at its other end with an interlock mechanism carried by a follower bearing member (not illustrated in FIGS. 1 and 2) providing for low resistance movement of the outer end of the pressing bar 14 about the tubular heating body 12 when said pressing bar is driven by the revolvable carrier gear 17. The pressing bar 14 is provided along its length with short comb teeth 18 adapted to comb strands or locks of hair as they are being curled or wound about the tubular heating body 12 during use of the device, as is hereinafter more particularly described. Rotary adjustment buttons 55 and **59*a* comprising part of the pressing bar support mechanism serve to adjust resilient clamping pressure imparted by the pressing bar in accordance with the chosen thickness and texture of the hair strands to be operated upon, as is hereinafter more particularly described. In and out push buttons 21 and 22, respectively, serve to actuate the rotary movement of the pressing bar 14** in one direction or the other, selectively, about the tubular heating body 12 in the manner and for the purpose hereinafter more particularly described.

Referring now in greater detail to the drawings it will be seen that the handle 11, which will preferably be molded of synthetic plastic material, comprises a longitudinally-divided, two-piece housing 23 having upper and lower housing shell members 24 and 25 secured together as by screws 26 and 27. The upper and lower housing shell members 24 and 25 will preferably be injection molded, and will have integrally molded, at their insides, appropriate webbing, channeling, support posts and the like, only such details of which are described herein as is deemed to be necessary to facilitate a full understanding of the invention claimed.

With reference now to FIG. 3B it will be seen that the outer end of the housing 23, which also constitutes a handle for manipulation of the hair curler, is of substantially increased diametrical size to accommodate the enclosure therein of a reversible AC motor 28. The rotor shaft 29 of motor 28 is carried by bearing blocks 30 and 31 at each side of the motor. The motor commutator and brush support mechanism is indicated generally by reference numeral 32; and fan 33 carried at the distal projecting end of the rotor shaft serves to keep the motor cool. An electrical energization cord 34 (illustrated only in FIGS. 1, 2, and 3A) extends outwardly of the free end of handle 11, for plug-in connection with an ordinary household source of electrical supply.

The rotor shaft 29 is coupled through flexible coupling 35 to co-axial driven shaft 36 supported by longitudinally-spaced journal blocks 37 and **37*a* supported within lower handle shell member 25. The driven shaft 36 carries, at its forward end, a pinion 37 driven by motor 28 operating at a speed of 1750 rpm. Fixed within the forward end of handle housing 11 is a needle bearing assembly comprising tubular cage 39, bearing needles 40 and the carrier gear (ring gear) 17, said ring gear being in intermeshing engagement with pinion 27. The gear ratio of pinion 37 to carrier gear 17 will be such as to drive said carrier gear together with the pressing bar 14** at a speed of about 56 rpm.

With reference to FIGS. 3B and 7 it can be seen that the inner end of the tubular heating body 12, which may be molded of a suitable synethetic resin, is received within a cylindrical recess formed within the housing handle 11 and that the assembly screw 27 extends through a round opening at the top thereof for its securement therein. With reference to FIG. 7, it will be seen that a lower end portion of the tubular heating body 12 is cut away or sloted, as indicated at 41, to accommodate pinion 37.

As illustrated in FIG. 3, the tubular heating body 12 has frictionally retained therein a cylindrical heating element 42 the energizing conductors 43 and 44 of which are supported by laterally spaced grips 45 and 46 attached to the inside of said heating body above the pinion 37. The conductor grips 45 and 46 serve to maintain electrical feed conductors 43 and 44 to heating element 42 out of contact with pinion 37.

The pressing carrier mechanism extends forwardly outwardly of ring or carrier gear 17 and terminates in rectangular head portion 49 of increased size (see FIG. 6) having a rectangular opening 50 within which a rectangular block 51 is received for slidable adjustment in the vertical direction as illustrated in FIG. 3B. The slide block 51 is provided with an axial bore 52 within which push pin bar 16 is slidingly received. A helical compression spring 53 serves to constrain the push pin 16, together with the pressing bar 14, in the outward or forward direction. The push pin 16 is provided with an elongated opening 54 through which an adjustment screw 55 extends, said adjustment screw being threaded in the slide block 51. Manual adjustment of this screw serves to adjust the spacing between the pressing bar 14 and the tubular heating body 12.

As illustrated in FIG. 4, means is also provided for adjustably positioning the outer extremity of pressing bar 14 with respect to tubular heating body 12. To this end, the outer end of pressing bar 14 is received within a rectangular opening 56 in a pressing bar lock member 57 having a forwardly projecting tip 58. A headed adjustment screw **59*a* threaded in an opening 60 in the lock bar member 57 carriers the outer end of pressing bar 14 and serves to adjustably space said outer end with respect to the tubular heating body 12. The forwardly projecting tip portion 58 of the pressing lock bar member 57 is removably receivable within a rectangular opening 59 comprising inner ring 62 of a needle bearing comprising needles 63 assembled within an annular recess 64 formed in body portion 65 integrally formed with hair separating tooth 13. In operation, it will be understood that thumb pressure applied to thumb piece 66 formed at the inner end of pressing bar 14 will move said pressing bar rearwardly against the reactive urging of helical compression spring 53 to remove tip portion 58 from its recess 59, thereby allowing said pressing bar to swing upwardly and away from the tubular heating body 12 to permit placement of a lock or strands of hair to be curled. It will further be understood that the needle bearing assembly comprising inner ring 62 and bearing needles 63 permits free turning of the outer end of the pressing bar 14 when driven by carrier gear 17**, as hereinabove described.

Push button means is provided for controlling the energization of reversible drive motor 28 to drive the pressing bar 14 in one direction or the other, selectively, about the tubular heating body 12. To this end, push buttons 21 and 22 projecting through the upper surface of upper housing shell member 24 are undercut to provide shoulders 67, 68, respectively, which bear against outer end portions of an underlying, electrically conductive switch contact bar 69. The switch contact bar 69 is pivotally supported at a central position therealong as by a transverse spring clip 70 the opposing journal pin ends of which are anchored in support posts 71, 72 integrally molded at the inside of upper housing shell 24. As illustrated in FIG. 11, electrical contact pairs 73, 74 comprising an insulating support member 75 are fixed to support shelf 76 integrally molded within upper housing shell member 24 as by screw 77. Pressing down upon push button 21 serves to swing the switch contact bar 69 in the counter-clockwise direction as illustrated in FIG. 3, to establish electrical contact between electrical contacts 73, 74, thereby energizing the drive motor to turn in one direction (the "in" direction) and operation of the hair curler as is hereinafter more particularly described. Depressing push button 22 conversely will establish electrical contact between contact elements 78 and 79 comprising insulating support member 80 affixed to shelf member 81 as by screw 82, thereby energizing the drive motor to turn in the opposite direction (the "out"direction).

Clutch means is provided to prevent turning of the pressing bar 14 in either direction about the tubular heating body 12 unless one or the other of the directional control push buttons 65 or 66 is actuated. To this end, as best illustrated in FIGS. 3B, 8, 9, and 10, the driven shaft 36 has affixed, in spaced relation therealong, a pair of clutch gear 83, 84, normally engaged from underneath by half-circle clutch pawl portions 85,86, respectively, which comprise a clutch pawl assembly 87. The clutch pawl assembly 87 comprises a central support leg portion 88 terminating in a horizontally-extending support base 89 having a pair of spaced, rectangular locating openings 90, 91 through which upstanding locating pins 92, 93 molded within the inside bottom of the lower housing shell member 25 extend for pivotally supporting said assembly. A helical compression spring 94 constrained between the inner bottom surface of the lower housing shell member 25 and the base 89 serves to resiliently urge the clutch pawl assembly 87 in the upward direction, as illustrated in FIG. 3B, so that the clutch pawl portions 85, 86 will be in interlocking engagement with respect to their respective clutch gears 83, 84. With reference to FIGS. 9 and 10, it will be observed that the inclined teeth of the clutch gears 83 and 84 are so directed that when engaged by their respective clutch pawl portions 85, 86 they will be able to turn only in one direction, the direction called for upon actuating one or the other of the push button switches 21, 22. In order to disengage the appropriate clutch gear so that the drive motor can turn the pressing bar 14 in the direction called for, each push button 21, 22 is integrally molded with a downwardly-extending portion 90, 91, respectively, which bears at its lower end against an upper portion of the clutch pawl assembly 87 directly above its associated clutch gear. Thus, when either of the push buttons 21, 22 is activated to energize the drive motor to turn in one direction or the other as described above, the corresponding clutch pawl 85 or 86 will at the same time be disengaged from its clutch gear, thereby permitting the driven shaft 36 to turn in the direction called for. When neither of push buttons 21, 22 is depressed, during use of the curling iron, such as while waiting for the heat of the tubular heating body 12 to take effect upon a lock of hair wound thereabout by the previously rotated pressing bar 14, both clutches will be engaged, thereby locking the pressing bar in place.

As further illustrated in FIG. 3B, helical compression springs 95, 96 circumjacent downwardly-extending portions 90, 91 respectively, of push buttons 21, 22, have their upper ends fixed to their respective downwardly extending portions, and their other ends constrained against upper surface portions of the clutch pawl assembly 87, thereby normally urging the push buttons 21, 22 in the outward direction. As further illustrated in FIGS. 3B, 9, and 10 helical compression spring 97, 98 supported in tubular posts 99 and 100 integrally molded with the respective pawls 85, 86 serve to yieldingly urge the clutch pawl members 85 and 86 in intermeshing engagement with their respective clutch gears 83 and 84.

In use, the automatic curling iron will be plugged into an ordinary household source of electrical supply, whereupon the heating element 42 will immediately begin to heat the tubular heating body 12, preparing it for use. Thumb pressure applied to pressing bar thumb piece 66 releases said pressig bar, allowing it to swing upwardly and away from the tubular heating body 12 to permit the placement of a lock or strands of hair to be curled. The fixed tooth 13 at the outer end of the curling iron facilitates separation of the chosen strands of hair to be curled in any particular operation. With the hair now over the heating body, the comb pressing bar 14 will be locked in place again, as hereinabove described, its setting having been adjusted by means of adjustment screws 55 and 59*a*. The hair is now pressed between the pressing bar comb and the heating body, ready for curling. To curl the hair in one direction, it is only necessary to press down upon the "in" push button 21. Subsequent pressing of the "out" button 22 reverses the procedure, curling the hair in the opposite direction. As is hereinabove described it will be understood that the push button drive motor control mechanism is such that only one electrical switching of the control motor can be effected at a time, that is either forward or reverse direction, and that this switching is accomplished indirectly through action of the pivotally supported switch contact bar 69, thereby eliminating the possibility of electrical shock or shorting.

While I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. An automatic hair curling iron comprising, in combination, a handle member, an elongated tubular heating member fixed with respect to and extending outwardly at one end of said handle member, an electrical heating element within said heating member, an elongated pressing bar, mechanism supporting said elongated pressing bar in spaced relation along the outside of said tubular heating member, said pressing bar supporting mechanism comprising means pivotally supporting the inner end of pressing bar to permit its upward swinging movement for the insertion of strands of hair to be pressed between said pressing bar and said tubular heating member, an electric drive motor, and mechanism interconnecting said electric drive motor with the inner of said pivotally supporting means for automatic rotation of said pressing bar circularly about both said heating member and said handle member upon energization of said electric drive motor.

2. An automatic hair curling iron as defined in claim 1 including a hair separating tooth fixed with respect to and extending outwardly of the outer end of said elongated tubular heating member.

3. An automatic hair curling iron as defined in claim 1 wherein said handle member is hollow, said drive motor comprising a reversible electric motor housed within said handle member, and push button means selectively operable to drive said motor in one direction or the other for turning said pressing bar in one direction or the other about said tubular heating member.

4. An automatic hair curling iron as defined in claim 3 including clutch mechanism for constraining the rotation of said pressing bar about said tubular heating member and clutch mechanism for preventing free turning of said pressing bar about said tubular heating member except when driven by said drive motor.

5. An automatic hair curling iron as defined in claim 4 wherein said push button means comprises a pair of thumb-actuable push buttons supported at the forward end of said handle member, and means controlled by the actuation of one of said push buttons to prevent the simultaneous actuation of the other push button.

6. An automatic hair curling iron as defined in claim 5 including means for adjusting the spacing of said elongated pressing bar with respect to the outside of said tubular heating member.

7. An automatic hair curling iron as defined in claim 6 wherein said drive motor interconnecting mechanism comprises a motor drive output shaft, a pinion gear carried by said shaft, a ring gear driven by said pinion, said ring gear being concentric with said tubular heating member, said pressing bar pivotally supporting means being secured to said ring gear.

8. An automatic hair curling iron as defined in claim 7 including rotary support means at the other end of said tubular heating member, said pressing bar supporting mechanism comprising releasable means interconnecting the outer end of said pressing bar with said rotary support means.

9. An automatic hair curling iron as defined in claim 8 wherein said rotary support means comprises a needle bearing.

10. An automatic hair curling iron as defined in claim 9 including a hair separating tooth member fixed with respect and extending outwardly of the outer end of said elongated tubular heating member, said hair separating tooth being comprised of material having a comparatively low heat conductivity as compared with the heat conductivity of said tubular heating member, said needle bearing being supported by said tooth member.

* * * * *